United States Patent [19]

Mukoyoshi et al.

[11] Patent Number: 4,960,638

[45] Date of Patent: Oct. 2, 1990

[54] RECORDING SHEET

[75] Inventors: Shunichiro Mukoyoshi, Nishinomiya; Tsunefumi Yamori, Kobe; Shigekazu Shuku, Nara; Hironari Fujioka, Takatsuki, all of Japan

[73] Assignee: Kanzaki Paper Manufacturing Co., Ltd., Tokyo, Japan

[21] Appl. No.: 306,749

[22] Filed: Feb. 6, 1989

[30] Foreign Application Priority Data

Feb. 8, 1988 [JP] Japan ..... 63-27011

[51] Int. Cl.[5] ..... B41M 5/00

[52] U.S. Cl. ..... 428/342; 346/135.1; 428/195; 428/341; 428/423.1; 428/483; 428/507; 428/516

[58] Field of Search ..... 346/135.1; 428/195, 428/423.1, 914, 341, 342, 507, 516, 483

[56] References Cited

U.S. PATENT DOCUMENTS 4,642,247 2/1987 Mouri et al. ..... 428/195

FOREIGN PATENT DOCUMENTS 59-33177 2/1984 Japan ..... 503/227

*Primary Examiner*—Pamela R. Schwartz

*Attorney, Agent, or Firm*—Wenderoth, Lind & Ponack

[57] ABSTRACT

Provided herein is a recording sheet composed of a support base and a recording layer formed thereon. The recording layer is formed by curing, with radiation, a material composed mainly of a hydrophilic resin prepolymer curable with radiation, said prepolymer having a polyether skeleton and ethylenic unsaturated groups curable with radiation at both terminals thereof.

The recording sheet permits printing and drawing on an ink jet printer or pen plotter which uses water-based ink. The recording layer permits the writing and coloring in a water-based ink with a pen, marker, or fountain pen and yet has good water resistance. The recording sheet is particularly useful as a transparency for overhead projectors.

5 Claims, No Drawings

RECORDING SHEET

FIELD OF THE INVENTION

The present invention relates to a recording sheet which is well suited for writing upon with water-based ink. More particularly, it is concerned with a recording sheet which exhibits good writing quality for a water-based ink pen and is suitable for use in an ink jet printer or a pen plotter which performs recording with water-based ink.

BACKGROUND OF THE INvENTION

Plastics film, metallized paper, metal foil, film-laminated paper, and the like which are now in use in many areas are not sufficiently suitable for writing upon with a water-based ink. This poses a problem in some uses. For example, plastics film (usually polyethylene terephthalate film) used as a transparency for an overhead projector (OHP for short hereinafter) has a disadvantage that it does not accept a water-based ink. Therefore, it is necessary to color the transparency with an oil-based ink or a paste colored film to the transparency in the case where it is desired to produce a visually appealing image. (OHP transparencies are monochrome because they are usually produced by copying characters and drawings from books or literature by the aid of an electronic duplicating machine such a Xerox.) A similar disadvantage is encountered in plastics film for an ink jet printer or a pen plotter which uses a water-based ink, and also in OHP transparencies coated with polyester resin for the improvement of toner fixing and image density. These films are poor in writing quality for the water-based ink and do not absorb and fix the water-based ink.

SUMMARY OF THE INVENTION

It is a principal object of the present invention to provide a recording sheet free of the aforesaid disadvantages, which permits the printing and drawing on an ink jet printer or a pen plotter which uses a water-based ink. The recording sheet is provided with a recording layer which permits the writing and coloring thereupon with a water-based ink from a pen, marker, or fountain pen and yet has good water resistance. The recording sheet exhibits good writing quality and absorbs and fixes water-based ink.

It is another object of the present invention to provide a recording sheet suitable for use in an OHP (overhead projector).

The recording sheet of the present invention comprises a support base and a recording layer formed thereon by curing, with radiation, a material composed mainly of a hydrophilic resin prepolymer curable with radiation, said prepolymer having a polyether skeleton and ethylenic unsaturated groups curable with radiation at both terminals thereof.

DETAILED DESCRIPTION OF THE INVENTION

The present invention was completed to eliminate the aforesaid disadvantages encountered in the conventional recording sheet, thereby achieving the aforesaid objects. The present invention provides a recording sheet which comprises a support base and a recording layer formed thereon by curing, with radiation, a material composed mainly of a hydrophilic resin prepolymer curable with radiation, said prepolymer having a polyether skeleton and ethylenic unsaturated groups curable with radiation at both terminals thereof.

The support base used for the recording sheet of the present invention is not specifically limited; but it includes, for example, plastics film, metal foil, vacuum metallized paper, film laminated paper, coated paper, and plain paper. According to the present invention, the support base is provided with a recording layer which has a good receptivity to water-based ink. Being transparent, the recording layer is particularly suitable for a transparent support base such as the one used for OHP transparencies.

The support base for OHP transparencies is usually selected from plastic films from the standpoint of transparency. Among plastic films in general use may be mentioned polypropylene film, polyethylene film, and polycarbonate film, etc. In the case where the transparencies are prepared by an electronic duplicating machine, the support base should preferably be selected from polyester film, polysulfone film, cellulose ester film, polyamide film, and polyimide film, etc. which have good heat resistance.

According to the present invention, the support base has a recording layer which is formed thereon by curing, with radiation, a material composed mainly of a hydrophilic resin prepolymer curable with radiation, said prepolymer having a polyether skeleton and ethylenic unsaturated groups curable with radiation at both terminals thereof. The prepolymer is composed of the repeating units of -(M-O)-, where M denotes a methylene group, ethylene group, polymethylene group, or a derivative thereof, and the repeating units may contain one or more than one kind of M.

According to the present invention, it is essential that the prepolymer be hydrophilic, preferably soluble in water. In addition, the prepolymer should have a chain length in the range of 50 to 1000 Å. In other words, it should have an average molecular weight in the range of 300 to 10000, preferably 500 to 8000. With an average molecular weight smaller than 300, the prepolymer yields an excessively cured recording layer which is poor in writing quality, receptivity, and drying performance for water-based ink. With an average molecular weight in excess of 10000, the prepolymer yields a recording layer which is poor in strength and water resistance.

The prepolymer should preferably have the skeleton of polyoxyethylene represented by the formula [I] below, so that it has a better hydrophilic nature.

$$-O-(CH_2-CH_2-O)_n- \qquad [I]$$

It is important that the "n" should be in the range defined by $10 \leqq n \leqq 150$. With a value of "n" smaller than 10, the prepolymer yields a recording layer which has poor writing quality and receptivity for water-based ink. With a value of "n" greater than 150, the prepolymer yields a recording layer which is poor in water resistance.

According to the present invention, the prepolymer should have ethylenic unsaturated groups at both terminals of the polyether skeleton. The ethylenic unsaturated groups may be introduced directly into both terminals of the polyether skeleton; however, it is also possible to introduce them by connecting a (meth)acrylate having a hydroxyl group to the terminal through a diisocyanate. The resulting product has the structure of polyether urethane (meth)acrylate. The prepolymer of such structure readily cures to provide a tough recording layer.

The diisocyanate used for this purpose is not specifically limited. It includes, for example, isophorone diisocyanate, tolylene diisocyanate, xylylene diisocyanate, hexamethylene diisocyanate, lysine diisocyanate, 4,4'-methylenebis(cyclohexylisocyanate), methylcyclohexanol 2,4(2,6) diisocyanate, 1,3-(isocyanatemethyl) cyclohexane, and trimethylhexamethylene diisocyanate.

The aforesaid ionizing radiation-curable resin prepolymer should preferably have a structure as represented by the formula [II] below.

$$CH_2{=}CR{-}\overset{O}{\overset{\|}{C}}{-}O{-}R_1{-}O{-}\overset{O}{\overset{\|}{C}}{-}NH{-}R_2{-}NH{-}\overset{O}{\overset{\|}{C}}{-}O{\leftarrow}CH_2{-}CH_2{-}O{\rightarrow}_n\overset{O}{\overset{\|}{C}}{-}NH{-}R_2{-}NH{-}\overset{O}{\overset{\|}{C}}{-}O{-}R_1{-}O{-}\overset{O}{\overset{\|}{C}}{-}CR{=}CH_2 \quad [II]$$

were R denotes a hydrogen atom or methyl group; $R_1$ and $R_2$ each denotes an aliphatic group, alicyclic group, or aromatic group; and n is preferably in the range defined by $10 \leqq n \leqq 150$.

The prepolymer having the formula given above is known as a prepolymer to immobilize enzymes and microorganisms. It was found to produce a marked effect when used as a principal component of the composition for the recording layer which characterizes the recording sheet of the present invention. This finding led to the present invention.

It is not fully elucidated why the aforesaid prepolymer yields the recording layer which has good receptivity to water-based ink and also has good water resistance. The reason may be explained as follows: The prepolymer itself has a good hydrophilic nature. Having the chain structure of adequate length, it produces a proper crosslink density when it is crosslinked through the ethylenic unsaturated groups with radiation. Therefore, the recording layer formed by crosslinking absorbs water while keeping water resistance. Thus it accepts and absorbs water-based ink rapidly.

The coating composition for the recording layer is composed mainly of the aforesaid resin prepolymer curable with radiation. It may be incorporated with radiation-curable monomers or oligomers in addition to said prepolymer in order to control the crosslink density and hydrophilic nature. Such monomers or oligomers should be compatible with said prepolymer and also should be hydrophilic so that the resulting recording layer has good writing quality for water-based ink. They include the following examples.

(a) Monofunctional monomers or oligomers

Carboxyl group-containing monofunctional monomers or oligomers represented by ethylenically unsaturated monocarboxylic acids such as (meth)acrylic acid and (meth)acrylic acid dimer and trimer represented by $CH_2{=}CR.COO.(CH_2CHR.COO)_n.H$ (where $1 \leqq n \leqq 20$, and R denotes a hydrogen atom or a methyl group); and mono-functional monomers or oligomers containing carboxylate groups represented by the alkali metal salts, ammonium salts, and amine salts of said ethylenically unsaturated monocarboxylic acids or polycarboxylic acids.

Amide group-containing monofunctional monomers or oligomers represented by ethylenically unsaturated (meth)acrylamide, alkyl-substituted (meth)acrylamide, and N-vinylpyrrolidone.

Sulfonic acid group-containing monofunctional monomers or oligomers represented by aliphatic or aromatic vinylsulfonic acids; and sulfonate group-containing monofunctional monomers or oligomers represented by alkali salts, ammonium salts, and amine salts of said aliphatic or aromatic vinylsulfonic acids.

Hydroxyl group-containing monofunctional monomers or oligomers represented by 2-hydroxyethyl (meth) acrylate.

Epoxy group-containing monofunctional monomers or oligomers represented by glycidyl (meth)acrylate.

Quaternary ammonium salt group-containing monofunctional monomers or oligomers.

(b) Polyfunctional monomers or oligomers

Condensates of polyhydric alcohol (or polyhydric alcohol condensate) and (meth)acrylic acid, represented by ethylene glycol di(meth)acrylate, diethylene glycol di(meth)acrylate, polyethylene glycol di(meth)acrylate, and glycerin mono, di or tri(meth) acrylate.

N,N'-methylenebis(meth)acrylamide.

The coating composition for the recording layer may be incorporated with an antistatic agent, lubricant, dispersing agent, dye, pigment, antiblocking agent, wetting agent, leveling agent, defoamer, etc. according to need. It may also be incorporated with a radiation-curable resin (other than that mentioned above) and a resin not curable with radiation, in an amount not harmful to the effect of the present invention.

The coating composition for the recording layer should be applied to at least one side of the support base. Application may be carried out by using an ordinary coating machine such as bar coater, roll coater, air knife coater, and gravure coater.

The coating composition used in the present invention may be prepared in the absence of water or solvent; however, at the time of application, it is usually dissolved or dispersed in a solvent, particularly a hydrophilic solvent or water, for the reduction of viscosity.

Examples of the hydrophilic solvents include methyl alcohol, ethyl alcohol, propyl alcohol, methyl cellosolve, and ethyl cellosolve. Water is preferable because of its safety and ease of handling.

After application, the coating composition may be dried prior to radiation. The coating composition yields a recording layer which exhibits good writing quality for water-based ink when it is irradiated, where it still contains a certain amount of water or solvent. In this case, the coating fluid should contain preferably 10 to 95 wt%, more preferably 30 to 80 wt%, of solids During irradiation, part or all of the water or solvent will evaporate from the coated film. When the coated film is still sticky after irradiation, it is desired to be dried in an additional drying stage.

The aforesaid coating composition should be applied such that the coating weight is preferably in the range of 0.1 to 20 g/m$^2$, more preferably in the range of 0.2 to 10 g/m$^2$. With a coating weight less than 0.1 g/m$^2$, the coating film does not produce the desired effect of the present invention. With a coating weight in excess of 20 g/m$^2$, the coating film does not produce any additional effect.

The coating surface of the support base should be pretreated with anchor coating, corona discharge, irradiation, or plasma, according to need, for the improvement of wettability and adhesion to the recording layer.

After the application of the coating composition, the coating layer is cured with radiation. Examples of the radiation include electron beam, ultraviolet rays, α-rays, β-rays, γ-rays, and X-rays. The former two are preferable because of their ease of handling and the commercial availability, whereas as for the latter four, due regards are necessary because of their danger to human bodies.

In the case of irradiation with electron beam, the dosage should preferably be in the range of 0.1 to 20 Mrad. With a dosage less than 0.1 Mrad, the irradiation does not produce the desired effect. With a dosage in excess of 20 Mrad, the irradiation would deteriorate the support base, particular paper and plastic films of certain kinds. The irradiation with electron beam may be accomplished by scanning type, curtain beam type, or broad beam type accelerator. The accelerating voltage for electron beam should be 100 to 300 kV. An advantage of the irradiation with electron beam is that it gives a higher productivity than the irradiation with ultraviolet rays, and it poses no problems of odor and discoloration resulting from the photoinitiator for ultraviolet rays.

In the case of irradiation with ultraviolet rays, the coating composition should be incorporated with one or more photoinitiators. Examples of such photoinitiator include thioxanthone, benzoin, benzoin alkyl ether xanthone, dimethyl xanthone, benzophenone, anthracene, benzil 2,2-diethoxyacetophenone, benzyldimethylketal, benzyldiphenyl disulfide, anthraquinone, 1-chloroanthraquinone, 2-ethylantraquinone, 2-tert-butylanthraquinone, N,N'-tetraethyl-4,4'-diaminobenzophenone, and 1,1-dichloroacetophenone.

The amount of the photoinitiator should be preferably 0.2 to 10 wt%, more preferably 0.5 to 5 wt%, of the component curable with radiation. For the acceleration of curing, the photoinitiator may be used in combination with a tertiary amine such as triethanolamine, 2-dimethylamino ethanol, dimethylaminobenzoic acid, isoamyl dimethylaminobenzoate, dioctylaminobenzoic acid, and lauryl dimethylaminobenzoate. The amount of the tertiary amine should be preferably 0.05 to 3 wt% of the component curable with radiation.

The ultraviolet rays for irradiation should be supplied by 1 to 50 ultraviolet ray lamps (low-, medium-, and high-pressure mercury vapor lamps with the working pressure ranging from several mmHg to about 10 atm), xenon lamps, or tungsten lamps. The ultraviolet rays used for irradiation should preferably have an intensity of 5000 to 8000 $\mu W/cm^2$.

DESCRIPTION OF THE PREFERRED EMBODIMENTS

The invention will be described in more detail with reference to the following examples, which are not intended to restrict the scope of the invention. In the examples, quantities are expressed in terms of parts by weight and wt%, unless otherwise indicated.

EXAMPLES 1 to 3

Three kinds of recording sheets were prepared in the following manner. A polyethylene terephthalate film (100 μm thick) with anchor coating for improved adhesion was coated with a coating composition containing the prepolymer represented by the formula [III] below such that the coating weight was 5 $g/m^2$ (on dry basis). The coating film in the wet state was irradiated with 5 Mrad of electron beam using an irradiation apparatus ("Electrocurtain ®" CB150, made by ESI Co., Ltd.).

Formula [III]

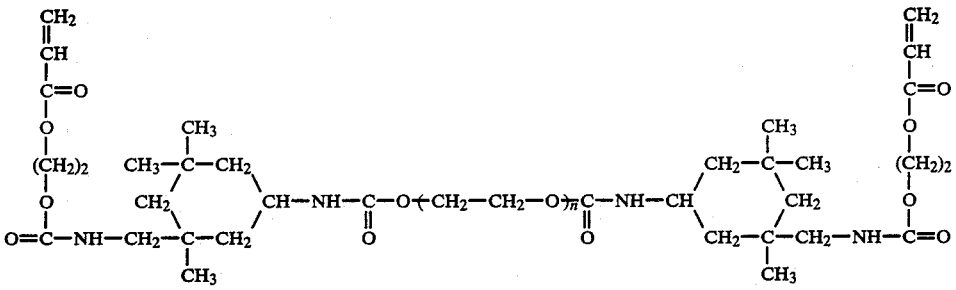

EXAMPLE 1

In this example, the hydrophilic, radiation-curable resin prepolymer represented by formula [III] was a 50% aqueous solution of ENT2000 (made by Kansai Paint Co., Ltd.) having an average molecular weight of about 2700. In formula [III], n is about 45, and the chain length is about 200 Å.

EXAMPLE 2

In this example, the hydrophilic, radiation-curable resin prepolymer represented by formula [III] was a 50% aqueous solution of ENT1000 (made by Kansai Paint Co., Ltd.) having an average molecular weight of about 1700. In formula [III], n is about 23, and the chain length is about 100 Å.

EXAMPLE 3

In this example, the hydrophilic, radiation-curable resin prepolymer represented by formula [III] was a 50% aqueous solution of ENT3400 (made by Kansai Paint Co., Ltd.) having an average molecular weight of about 3800 In formula [III], n is about 70, and the chain length is about 400 Å.

EXAMPLE 4

A recording sheet was prepared in the same manner as in Example 1 except that the coating fluid was replaced by a 50% aqueous solution of a mixture composed of (1) 600 parts of 50% aqueous solution of ENT2000 (300 parts on solids basis), (2) 200 parts of 50% aqueous solution of acrylamide (100 parts on solids basis), (3) 100 parts of polyethylene glycol diacrylate (NK ESTER A400, made by Shin-Nakamura Chemical Co., Ltd.), and (4) 100 parts of water.

EXAMPLE 5

A recording sheet was prepared in the same manner as in Example 1 except that the coating fluid was replaced by a 60% aqueous solution of a mixture composed of (1) 200 parts of ENT1000, (2) 200 parts of 50% aqueous solution of acrylamide (100 parts on solids basis), (3) 100 parts of polyethylene glycol diacrylate (NK ESTER A200, made by Shin-Nakamura Chemical Co., Ltd.), and (4) 166 parts of water.

EXAMPLE 6

A recording sheet was prepared in the same manner as in Example 1 except that the coating fluid was replaced by a 50% aqueous solution of a mixture composed of (1) 400 parts of 50% aqueous solution of ENT2000 (200 parts on solids basis), (2) 200 parts of 50% aqueous solution of sodium acrylate (75% neutralized) (100 parts on solids basis), (3) 100 parts of polyethylene glycol diacrylate (NK ESTER A200, made by Shin-Nakamura Chemical Co., Ltd.), and (4) 100 parts of water.

EXAMPLE 7

A recording sheet was prepared in the same manner as in Example 1 except that the coating fluid was replaced by a 50% aqueous solution of polyethylene glycol diacrylate (NK ESTER A1000, made by Shin-Nakamura Chemical Co., Ltd.) represented by the formula [IV] below, which is polyethylene glycol having an average molecular weight of 1000, with both terminals blocked with acryloyl groups.

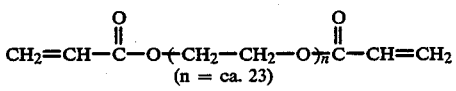

Formula [IV]

COMPARATIVE EXAMPLES 1 and 2

Recording sheets were prepared by coating the same support base as used in Example 1 with a coating fluid of water-soluble polymer specified below which is not curable with radiation. The coating weight was 2 g/m$^2$ (on dry basis). After application, each of the resultant coating films was dried at 100° C. for 5 minutes.

Comparative Example 1

In this comparative example, the water-soluble polymer is 10% aqueous solution of polyvinyl alcohol (PVA-117, made by Kuraray Co., Ltd.).

Comparative Example 2

In this comparative example, the water-soluble polymer is 2% aqueous solution of sodium acrylate polymer having an average molecular weight of about 2,000,000.

COMPARATIVE EXAMPLE 3

A recording sheet was prepared by coating the same support base as used in Example 1 with a coating fluid of ARONIX M6100 (made by Toa-Gosei Chemical Industry Co., Ltd.) which is hydrophobic, radiation-curable oligomer (difunctional oligoester acrylate having acryloyl groups at both terminals). The coating weight was 5 g/m$^2$ (on dry basis). After application, the resultant coating film was irradiated with 5 Mrad of electron beam in the same manner as in Example 1.

EVALUATION

Ten kinds of the recording sheets prepared in the examples mentioned above were evaluated in the following manner with respect to various evaluation items: writing quality, receptivity, and absorptivity for water-based ink, and resistance to water and solvent. There were obtained the results as shown in Table 1.

Writing quality for water-based ink

The recording sheet was examined to visually check if the repulsion of a water-based ink occurs in writing with a water-based ink pen.

Good: Almost no repulsion of the ink.

Poor: Unable to write due to excessive repulsion of the ink.

Receptivity and absorptivity for water-based ink

Evaluated in terms of time required for the recording sheet to fix the water-based ink completely. The fixation of water-based ink was confirmed by finger rubbing the ink softly on the recording sheet.

Excellent: Fixed within 5 seconds after writing.

Good: Fixed within 60 seconds after writing.

Poor: Not fixed even 1 hour after writing, but easily rubbed off.

Water resistance

Evaluated by checking if the recording layer is damaged when three drops of water are placed on the recording layer by using a dropping pipet and then they are wiped off with gauze.

Excellent: Not damaged at all.

Good: Slightly damaged, but harmless for practical use.

Poor: Completely damaged (stripped off).

Solvent resistance

Evaluated by checking if, the, recording layer is damaged when three drops of toluene are placed on the recording layer using a dropping pipet and then they are wiped off with gauze.

Good: Not damaged at all.

TABLE 1

| | Writing Quality | Fixing and absorptivity | Water resistance | Solvent resistance |
|---|---|---|---|---|
| Example 1 | Good | Excellent | Excellent | Good |
| Example 2 | Good | Good | Excellent | Good |
| Example 3 | Good | Excellent | Good | Good |
| Example 4 | Good | Excellent | Excellent | Good |
| Example 5 | Good | Excellent | Excellent | Good |
| Example 6 | Good | Excellent | Excellent | Good |
| Example 7 | Good | Good | Good | Good |
| Comparative Example 1 | Good | Good | Poor | Good |
| Comparative Example 2 | Good | Good | Poor | Good |
| Comparative Example 3 | Poor | Poor | Good | Good |

It is noted from Table 1 that the recording sheet obtained in each example of the present invention has a recording layer which exhibits good writing quality, and excellent or good ink fixing and absorbing performance for water-based ink, and also has excellent or good water resistance and solvent resistance.

It has been also experimentally confirmed that the recording sheet according to the present invention desirably permits toner to fix firmly and to make an image with an adequate density when it is used for duplication on an electronic duplicating machine. In addition, it has been experimentally confirmed that the recording sheet according to the present invention permits the marking with water-based ink on the duplicated image (characters and drawings) and the thus prepared OHP transparency produces a sharp, high-contrast projected image on a screen.

As mentioned above, the recording sheet of the present invention is particularly useful as an OHP transparency which exhibits very good writing quality for water-based ink. Therefore, it is of great commercial value.

What is claimed is:

1. A recording sheet which comprises a support base and a recording layer formed thereon by curing, with radiation, a material containing a hydrophilic resin prepolymer curable with radiation, said prepolymer having a polyoxyethylene skeleton represented by the formula:

$$-O\text{-}(CH_2-CH_2-O)_n-$$

wherein n is defined by $10 \leqq n \leqq 150$, and having ethylenic unsaturated groups curable with radiation at both terminals thereof, the coating weight of the recording layer being at least 0.1 $g/m^2$.

2. A recording sheet as claimed in claim 1, wherein the support base is transparent.

3. A recording sheet as claimed in claim 1, wherein the resin prepolymer curable with radiation is one which is formed by connecting (meth)acrylate having a hydroxyl group to the polyoxyethylene through a diisocyanate.

4. A recording sheet as claimed in claim 3, wherein the support base is transparent.

5. A recording sheet as claimed in claim 1, wherein the prepolymer has an average molecular weight in the range of 300 to 1000.

* * * * *